United States Patent [19]

Schumacher

[11] 4,095,933

[45] Jun. 20, 1978

[54] FUEL HANDLING AND COMBUSTION SYSTEM

[75] Inventor: John B. Schumacher, Huron, S. Dak.

[73] Assignee: International Commercial Enterprises, Inc., Alexandria, Va.

[21] Appl. No.: 830,027

[22] Filed: Sep. 2, 1977

[51] Int. Cl.[2] ..... F23D 11/44

[52] U.S. Cl. ..... 431/11; 431/248; 431/352

[58] Field of Search ..... 431/244, 242, 247, 248, 431/11, 350, 352, 353, 10

[56] References Cited

U.S. PATENT DOCUMENTS

| | | | |
|---|---|---|---|
| 1,030,843 | 6/1912 | Turner et al. | 431/247 |
| 1,384,943 | 7/1921 | Ferguson | 431/248 X |
| 1,635,445 | 7/1927 | Spletter | 431/248 |
| 2,983,312 | 5/1961 | Finley et al. | 431/248 X |
| 3,840,321 | 10/1974 | Moench et al. | 431/11 |

*Primary Examiner*—Edward G. Favors

[57] ABSTRACT

A simple and highly efficient fuel handling and combustion system and method are provided. The system includes preheating coils surrounding a perforated outer secondary air cylinder and a perforated inside fire control cone, in which combustion occurs. After flowing through the preheating coils, the fuel is compressed in at least one compression chamber before being released to the interior of the inside fire control cone through a spud orifice. Air mixes with the fuel only after the fuel is released from the spud. Substantially 100% combustion is achieved.

21 Claims, 4 Drawing Figures

FUEL HANDLING AND COMBUSTION SYSTEM

BACKGROUND OF THE INVENTION

This invention relates to fuel burners. More particularly, this invention relates to a fuel handling and combustion system that achieves greater heating efficiency with conventional fuels, such as any commercially available bottled fuel or source of combustible gas, than has heretofore been achieved. This is accomplished with a unique system for preheating and compressing the fuel and directly burning the fuel by mixing with ambient air at the point of ignition. The burner of the present invention uses only a single orifice, eliminates the requirement for a manifold or any premixing of the fuel with air, and achieves a flame that is substantially entirely an azure flame, cooler portions of the flame being eliminated.

SUMMARY OF THE INVENTION

To achieve the foregoing objects and in accordance with the purpose of the invention, as embodied and broadly described herein, the fuel handling and combustion system of the present invention comprises means for conveying fuel from a source to one end of the system; coil means for preheating and conveying the fuel to the other end of the system; at least one compression chamber; means to convey the preheated fuel from the coil means to the compression chamber; a spud having a spud orifice downstream of the compression chamber for releasing the fuel, prior to any admixture with air, at the other end of the system flowing in a direction toward the first end of the system along the central axis of the coil means; a perforated inside fire control cone surrounding the spud and located within the space enclosed by the coil means; and a perforated outer secondary air cylinder surrounding the fire control cone and located within the space enclosed by the coil means.

Preferably the system of the present invention further comprises an ignition means for igniting the fuel, which ignition means is preferably an ignition plug means located in the path of the fuel.

It is also preferred that the inside fire control cone is a double frustum with one end fitting snugly over the spud.

The method for fuel handling and combustion of the present invention comprises conveying fuel from a source to one end of a fuel handling and combustion system; conveying the fuel through a coiled conduit to the other end of the system to preheat the fuel; passing the fuel through at least one compression chamber at the other end of the system to compress the fuel; releasing the compressed fuel through a spud having a spud orifice, prior to any admixture with air, at the other end of the system flowing in a direction toward the first end of the system along the central axis of the coiled conduit; admitting air into the system through perforations in an outer secondary air cylinder located within the space enclosed by the coiled conduit and through perforations in an inside fire control cone surrounding the spud and located within the space enclosed by the outer secondary air cylinder; and burning the fuel within the inside fire control cone at a location spaced from the spud orifice, the fuel burning with substantially only an azure flame.

The accompanying drawings, which are incorporated in and constitute a part of this specification, illustrate several embodiments of the invention and, together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings.

Figure 1:
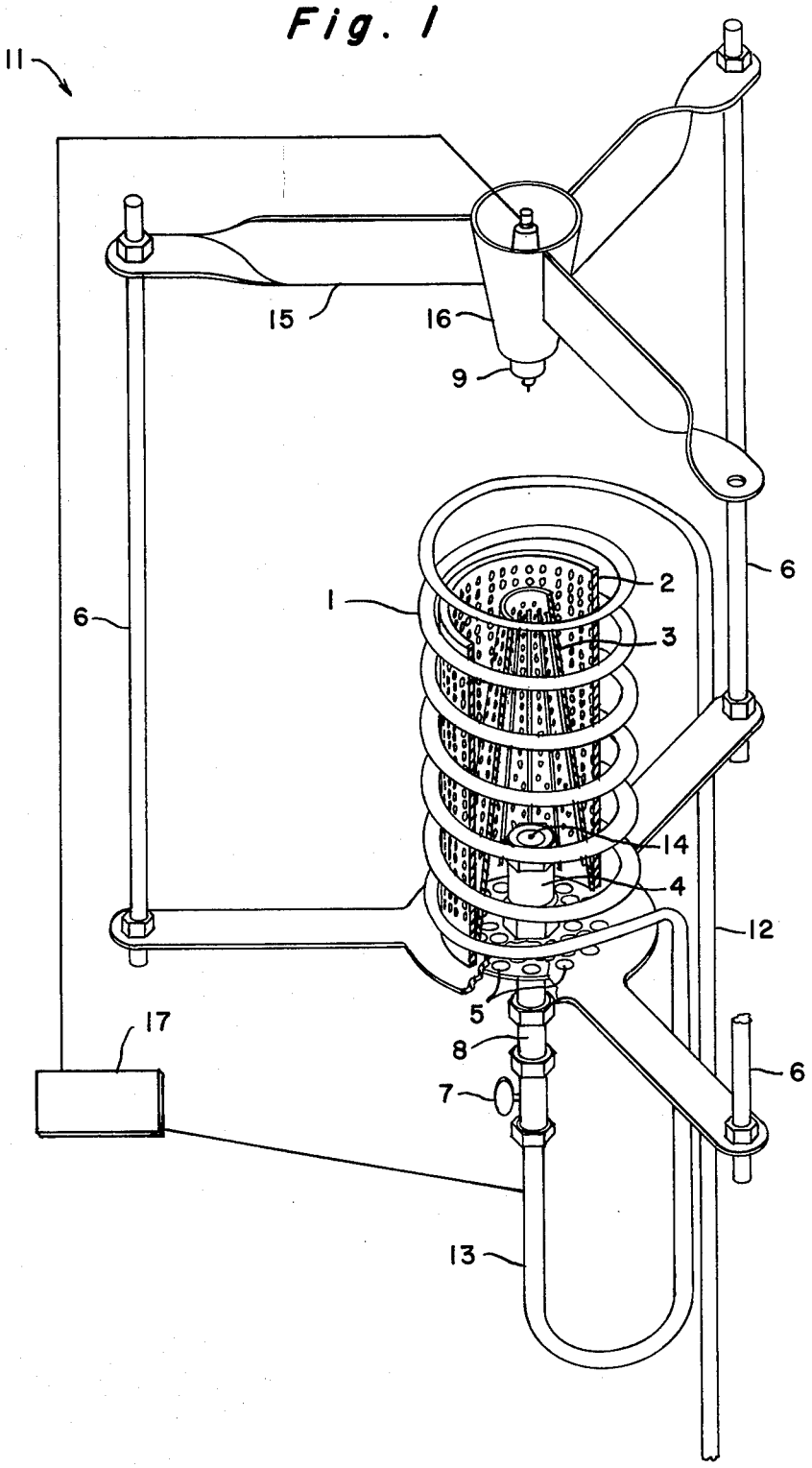
FIG. 1 is a perspective view of a fuel handling and combustion system constructed in accordance with the teachings of this invention.

A preferred embodiment of the fuel handling and combustion system is shown in FIG. 1 and is represented generally by the numeral 11. The system includes means for conveying fuel from a source to one end of the system. As embodied herein, this conveying means is a conduit 12 conveying fuel from any commercially available bottled fuel or source of combustible gas, e.g. natural gas, propane, butane, or propylene, to the coil means 1. In accordance with the invention, the coil means 1 is a gas coil conduit surrounding the fuel handling system and conveying the fuel from one end of the system to the other while preheating it.

The system further includes means to convey the preheated fuel from the gas coil at the bottom of the system to at least one compression chamber. As embodied herein, this conveying means is a conduit 13 including a shut-off control valve 7 and a safety check valve 8, which is a conventional one-way valve that prevents backfire.

The system further includes compression chambers and spud 4 including spud orifice 14, which releases gas at the central axis of the coiled conduit into the interior of a perforated inside fire control cone 3. Surrounding the inside fire control cone is a perforated outer secondary air cylinder 2.

In the embodiment illustrated in FIG. 1, two air control plates 5 are provided that have a plurality of holes, e.g., 36, and that can be rotated to close or open the holes to control the amount of air flowing through the bottom of the system.

An ignition means 9 is provided for igniting the fuel. As embodied herein the ignition means is an ignition plug means located in the path of the fuel and adjustably retained in position by unit-containing rods 6, straps 15, and heat-deflection cone 16. This ignition plug means, as embodied herein, is a spark plug modified by removal of its negative gap adjustment loop and by cutting back its metal casing on the negative side, e.g., with a lathe, by about 3/16 inches to expose more of the positive ceramic-insulated surface. The power source for activating the ignition plug is transformer 17 connected at one end to conduit 13 and at the other end to the ignition plug. The transformer may have the values listed below:

primary voltage 120
secondary voltage 7,500

V.A. 150
cycles 60
sec. M.A. 18

Although the ignition plug described herein is the preferred ignition means, other conventional ignition means may be used, such as conventional electrical arc means and pilot lights.

Figure 2:
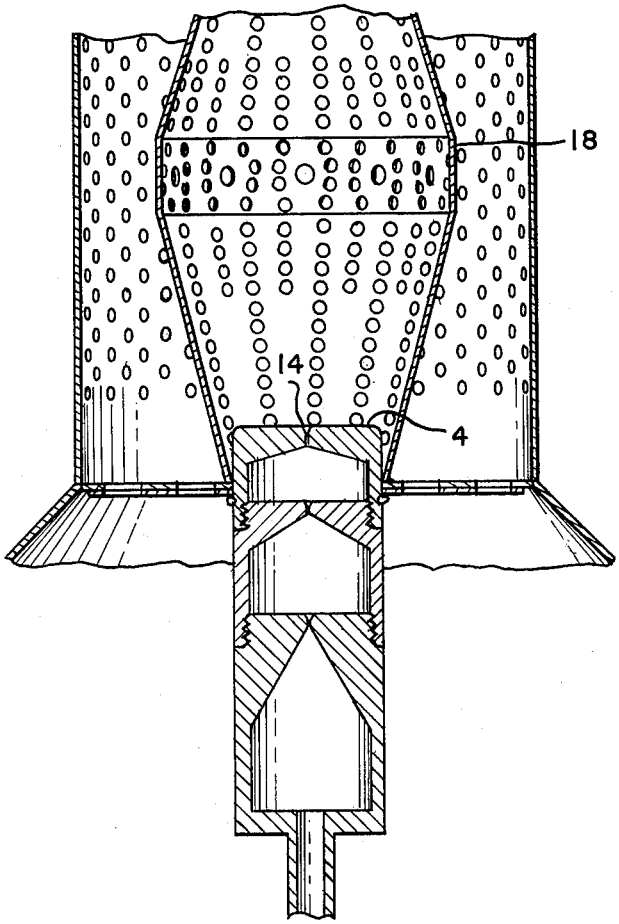
FIG. 2 is an exploded sectional view of a preferred embodiment of the present invention on the longitudinal axis thereof.

FIG. 2 illustrates a preferred inside fire control cone and illustrates the compression chambers and spud in greater detail. The preferred inside fire control cone is a double frustum with a belt 18 at its center. One end of the inside fire control cone fits snugly over the spud 4. In this embodiment, all air that mixes with the fuel must flow through the holes in the inside fire control cone.

The first compression chamber has the largest volume and terminates at its downstream end in a cone having an exit port at its apex, the interior angle of inclination of the cone from its longitudinal axis being 30°. The exit port of the first compression chamber is about 0.040 inch in diameter.

The second compression chamber has about half the volume of the first compression chamber, an angle of inclination at its downstream end of 60°, and an exit port of about 0.030 inch in diameter.

The third and last compression chamber has about $\frac{1}{4}$ the volume of the first compression chamber, an angle of inclination at its downstream end of 75°, and an exit port measuring about 0.020 inch in diameter. The exit port of the last compression chamber is the spud orifice 14.

A working model with the foregoing exit port dimensions and designed for use with propane had the following dimensions for the outer secondary air cylinder, the inside fire control cone, the air control plates 5, the coils, and the ignition plug 9:

Outer Secondary Air Cylinder 2

O.D. $2\frac{7}{8}$ inch
Length 5 inch
Holes 1008 1/64 inch D holes with 0.187 inch between centers, cut with rotating divider head Inside Fire Control Cone 3

Max O.D. $2\frac{1}{4}$ inch

Min. O.D.0 1 inch

Length $5\frac{3}{8}$ inch

Holes

Belt: 1 inch band, $12\frac{1}{8}$ inch D holes around center, 24 1/64 inch D holes in each of two outer rows located $\frac{1}{8}$ inch from end of belt, and 36 1/64 inch D holes with 0.187 inch between centers between the two outer rows; total = 12 + (2 × 24) + (36) = 96 Frustums: 232 1/64 inch D holes with 0.187 inch between centers on each frustrum;
total = 464

Two Air Control Plates 5

D $2\frac{3}{4}$ inch
Holes $36\frac{1}{4}$ inch D, cut with a rotating divider head Coils (stainless steel) 1

O.D. $\frac{1}{4}$ inch
Wall thickness 3/64 inch
Revolutions and location: 7 revolutions with $2\frac{3}{4}$ revolutions located above outer secondary air cylinder Ignition Plug 9

$\frac{7}{8}$ inch reach 14 mm with negative gap adjustment loop removed and metal casing on negative side cut back 3/16 inch Of course, the number of compression chambers and the dimensions of the compression chambers, the exit ports, the outer secondary air cylinder, the inside fire control cone, and the air control plates may vary depending on the size of the unit, the fuel that is used, and the temperature and amount of heat desired, and the values for these parameters can be easily determined by one of ordinary skill in the art using the principles of the present invention. For example, the embodiment of FIG. 2 is preferably used when the fuel source is propane. On the other hand, a greater number of compression chambers and larger exit ports would be preferred for natural gas, which has a lower heat value than propane.

Figure 3:
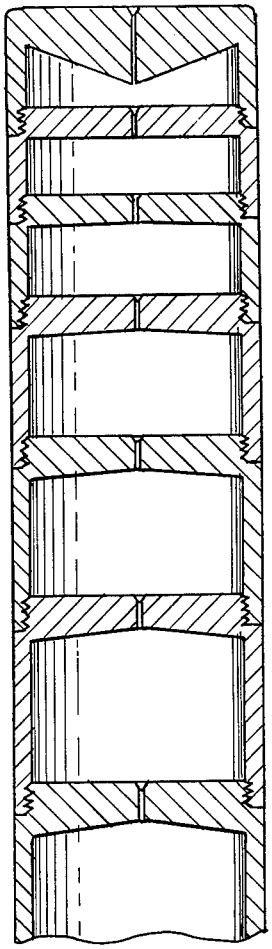
FIG. 3 is a sectional view of an alternative embodiment of the compression chambers and spud of the present invention.

The number of compression chambers may be one or any greater number to obtain the desired degree of compression. Preferably there are between three and eleven compression chambers, with each succeeding compression chamber having a smaller volume, a smaller exit port, and a larger angle of inclination for the cone at its downstream end. FIG. 3 illustrates eleven compression chambers such as would be preferred for the burning of natural gas. The tenth compression chamber has an angle of inclination of 90° at its downstream end and, therefore, is flat. The downstream end of the last compression chamber is an inverted cone, which increases the dwell time of the fuel being compressed. The spud orifice has a diameter of about 0.059 inch.

Figure 4:
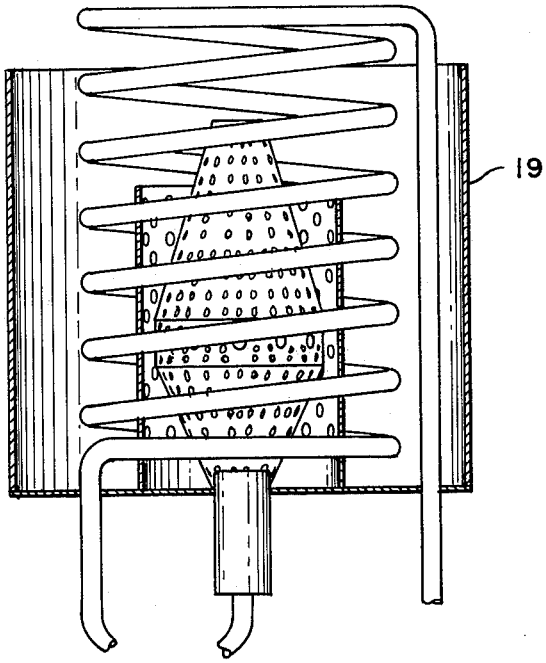
FIG. 4 is a sectional view of another embodiment of the system of the present invention.

Another alternative embodiment is illustrated in FIG. 4. In this embodiment an outside control can 19 completely surrounds the coils and forms an imperforate base plate at the bottom end of the system. Consequently, all air that mixes with the fuel must enter at the top of the can and flow in a direction opposite the direction of the burning fuel and between the coils of the coiled conduit to reach the point of ignition. The can thus encloses the entire burner and therefore is preferred for use in homes because of its greater safety in precluding entry by children. Also, the burner of this embodiment could be ignited by a simple flame rather than a transformer and ignition plug, allowing use in an environment where a source of electricity is unavailable. As an example, the can 19 can have a diameter of 5 inch and a length of $5\frac{1}{2}$ inch.

In operation, the fuel is conveyed from its source to the upper end of the system through conduit 12 and passes through gas coil 1, where it is preheated, and, if initially in the liquid state, vaporized. The fuel can be supplied at extremely low pressure, for example, about 6 psig, and higher pressures can be used to achieve higher heat power. Thus, conventionally supplied fuel sources can be used.

The fuel passes through conduit 13 into the compression chambers, where it undergoes stage compression and finally is released at an elevated pressure and temperature through spud orifice 14. The fuel then passes through the inside fire control cone 3 to ignition plug 9 activated by transformer 17 and is ignited immediately. The inside fire control cone 3 contains a ball of fire in its upper body that draws air through outer secondary air cylinder 2 and the inside fire control cone 3, as well as any openings provided in plates 5. These openings can be adjusted to adjust the flame as desired.

The unique conditions provided by the invention maintain the ball of fire in a turbulent state until the flame is ultimately released in an upward direction and deflected by cone 16 around the ignition plug 9. Nearly 100% combustion is achieved in a single part azure flame that eliminates the color blue and yellow parts usually present.

Obviously, the cone 16 and the inside fire control cone 3 must be made of heat-resistant materials, such as ceramic, because of the high temperatures, for example, about 2500° F, or even considerably higher, that can be achieved. These parts may be made of heat-resistant materials per se or of metal coated with a heat-resistant material. The remaining parts of the apparatus may be made of any suitable structural materials. The ignition plug is maintained at an elevated temperature during operation of the system and increases the system's efficiency, although it is electrically deactivated after ignition. Heat deflected past the ignition plug 9 and the cone 16 is transferred to an appropriate heat collection means such as a heat exchanger.

It will be apparent to those skilled in the art that various modifications and variations can be made in the fuel handling and combustion system of the present invention without departing from the scope or spirit of the invention. As an example, the number and size of holes in the inside fire control cone and the outer secondary air cylinder can be varied depending on the size of the unit, the fuel being used, and the flow rate of the fuel. Thus, it is intended that the present invention cover the modifications and variations of this invention provided they come within the scope of the appended claims and their equivalents.

What is claimed is:

1. A fuel handling and combustion system, comprising:

(a) means for conveying fuel from a source to one end of said system;

(b) coil means for preheating and conveying said fuel to the other end of said system;

(c) at least one compression chamber;

(d) means to convey said fuel from said coil means at said other end of said system to said compression chamber;

(e) a spud having a spud orifice downstream of said compression chamber for releasing said fuel, prior to any admixture with air, at said other end flowing in a direction toward said one end of said system along the central axis of said coil means;

(f) a perforated inside fire control cone surrounding said spud and located within the space enclosed by said coil means; and (g) a perforated outer secondary air cylinder surrounding said fire control cone and located within the space enclosed by said coil means.

2. The system of claim 1, further comprising ignition means for igniting said fuel.

3. The system of claim 2, wherein said ignition means is an ignition plug means located in the path of said fuel downstream of said one end of said system.

4. The system of claim 3, wherein said ignition plug means comprises a conventional spark plug that has been modified by removal of its negative gap adjustment loop and by cutting back its metal casing on the negative side, said system further comprising a transformer for activating said spark plug.

5. The system of claim 4, wherein said transformer is a 60 cycle, 7,500 volt transformer.

6. The system of claim 1, wherein said inside fire control cone is a double frustum with one end fitting snugly over said spud.

7. The system of claim 6, further comprising adjustable secondary air plates surrounding said spud for controlling the amount of air entering through said other end of said system.

8. The system of claim 6, further comprising an outside control can completely surrounding said coil means and forming a base at said other end of said system.

9. The system of claim 6, wherein said system includes a plurality of said compression chambers.

10. The system of claim 9, wherein each of said plurality of compression chambers after the first has a smaller volume and a smaller exit port than the preceding compression chamber, the exit port of the last compression chamber being the spud orifice.

11. The system of claim 10, wherein the downstream end of each compression chamber is a cone with the exit port at its apex, and wherein the angle of inclination of the cone of each compression chamber after the first is larger than that of the preceding compression chamber.

12. The system of claim 11, wherein the volume of each compression chamber after the first is about one half the volume of the preceding compression chamber and said spud orifice has a diameter of about 0.020 inch.

13. The system of claim 11, wherein there are eleven compression chambers, the cone of the tenth chamber has an angle of inclination of 90° and the cone of the eleventh chamber is inverted.

14. The system of claim 11, wherein the number of said compression chambers is between 3 and 11 inclusive.

15. A method for fuel handling and combustion, comprising:

(a) conveying fuel from a source to one end of a fuel handling and combustion system;

(b) conveying said fuel through a coiled conduit to the other end of said system to preheat said fuel;

(c) passing said preheated fuel through at least one compression chamber at said other end of said system to compress said fuel;

(d) releasing said compressed fuel through a spud having a spud orifice, prior to any admixture with air, at said other end flowing in a direction toward said one end of said system along the central axis of said coiled conduit;

(e) admitting air into said system through perforations in an outer secondary air cylinder located within the space enclosed by said coiled conduit and through perforations in an inside fire control cone surrounding said spud and located within the space enclosed by said outer secondary air cylinder; and (f) burning said fuel within said inside fire control cone at a location spaced from said spud orifice, said fuel burning with substantially only an azure flame.

16. The method of claim 15, further comprising igniting said fuel with an ignition means.

17. The method of claim 16, wherein said ignition means comprises a spark plug modified by removal of its negative gap adjustment loop and by cutting back its metal casing on the negative side, said spark plug being located downstream of said one end of said system in the path of said burning fuel.

18. The method of claim 17, wherein said modified spark plug is activated to cause ignition by a 60 cycle, 7,500 volt transformer.

19. The method of claim 15, further comprising controlling the amount of air entering said other end of said system by adjusting the size of openings in plates covering said other end of said system.

20. The method of claim 15, further comprising causing air to flow in a direction opposite the direction of the burning fuel and to flow between the coils of the coiled conduit to reach the point of ignition.

21. The method of claim 20, wherein said fuel is passed through between 3 and 11 compression chambers having progressively smaller volumes and progressively smaller exit ports.

* * * * *